US008832999B1

(12) United States Patent
Bell et al.

(10) Patent No.: US 8,832,999 B1
(45) Date of Patent: Sep. 16, 2014

(54) ROOFING PANEL SCREEN ASSEMBLY

(71) Applicant: Euramax International, Inc., Norcross, GA (US)

(72) Inventors: Robert Benjamin Bell, Douglasville, GA (US); James Ronald Wilson, II, Lindsborg, KS (US); Heath Morgan, Hemet, CA (US)

(73) Assignee: Euramax International, Inc., Norcross, GA (US)

( * ) Notice: Subject to any disclaimer, the term of this patent is extended or adjusted under 35 U.S.C. 154(b) by 0 days.

(21) Appl. No.: 14/022,706

(22) Filed: Sep. 10, 2013

(51) Int. Cl.
*E04D 13/00* (2006.01)
*E04D 13/08* (2006.01)
*E04D 13/076* (2006.01)

(52) U.S. Cl.
CPC ..... *E04D 13/076* (2013.01)
USPC ..... 52/12; 52/11; 52/13; 52/14; 52/15; 52/16

(58) Field of Classification Search
CPC ..... E04D 13/04; E04D 13/064; E04D 13/072; E04D 13/0725; E04D 13/0404; E04D 13/0445; E04D 13/0459; E04D 13/0481
USPC ..... 52/11–16
See application file for complete search history.

(56) References Cited

U.S. PATENT DOCUMENTS

| | | | | |
|---|---|---|---|---|
| 6,629,016 | B1 | 9/2003 | Smith | |
| 8,590,211 | B1 * | 11/2013 | Adams | 52/12 |
| 2004/0006927 | A1 * | 1/2004 | Wickett | 52/12 |
| 2005/0247611 | A1 * | 11/2005 | Groth et al. | 210/162 |

* cited by examiner

*Primary Examiner* — Mark Wendell
(74) *Attorney, Agent, or Firm* — Kilpatrick Townsend & Stockton, LLP

(57) ABSTRACT

A gutter screen assembly in having a screen across the ends of channels that extend into a gutter to prevent large debris from being washed from the channels into the gutter. The screen may be fabricated of expanded metal with a solid peripheral edge or of numerous other materials and structures.

5 Claims, 3 Drawing Sheets

ROOFING PANEL SCREEN ASSEMBLY

FIELD OF THE INVENTION

This invention relates to screens and other structures for keeping leaves and other debris out of a gutter associated with a roof or other similar structure.

BACKGROUND

Highly desirable roof and shade structures may be fabricated of aluminum, plastic or other composition components. Some such structures utilize generally horizontal channels having a generally U-shaped cross section with upward and/or outward-facing lips that engage similar lip structures (including standing seam structures) of adjacent channels to form a water-tight roof panel assembly. The U-shape not only captures and, if tilted, drains rainwater but is relatively easy to join to adjacent, like such channels. Moreover, the U-shape also provides a relatively rigid component that, when joined with other channels and properly supported, is capable of withstanding fairly significant snow, wind and other loads.

Channel ends (whether U-shaped or of other shapes) may be capped with another, preferably capped channel running orthogonal to the U-shaped channels. Such a capping channel can be a simple U-shaped or C-shaped channel into which the roofing channel ends are received. Preferably, in most situations, however, the structure into which the roofing channel ends are received should be a gutter having a trough of some sort so that at least slightly inclined roof channels can dump rainwater or snow melt into the gutter, and the gutter can convey the water to a downspout for conveying the water to the ground or into a drainage pipe, reservoir or other receiving component.

Desirable such gutter shapes provide not only a bottom support and gutter channel for conveying rainwater but include a cap to cover the U-shaped channel ends and further rigidify the entire roof structure.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

The roof or cover assembly described above is attractive, inexpensive and well-functioning. However, the U-shaped panels can convey not only water but also leaves and other debris into the gutter along with the rainwater or snow melt. Some such debris will be conveyed along the gutter and into any downspout or other conduit to which the gutter is conveyed. However, some larger debris will remain in and clog the gutter, and the geometry of the structure severely limits access to the gutter after assembly of the roof or cover, thereby making it very difficult to clean the gutter.

The roofing structure of this invention overcomes this problem with a screen assembled with the other roof and gutter components to block the end of the U-shaped channels with structure through which water will pass but leaves and other debris large enough potentially to remain in and clog the gutter will not pass.

Such blocking structure can be woven screen material, perforated sheet material, expanded sheet material such as expanded metal and variations of these structures or other structures with water passages too small to permit, or arranged or configured to prevent, passage of larger debris into the gutter. Any materials suitable for outdoor use in the environment the roof will experience may be used, including aluminum or other metals, plastics, plastic composites, woven and other structures made of metal wire, glass, ceramic, carbon, textile or other fibers.

BRIEF DESCRIPTION OF THE DRAWINGS

Illustrative embodiments of the present invention are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
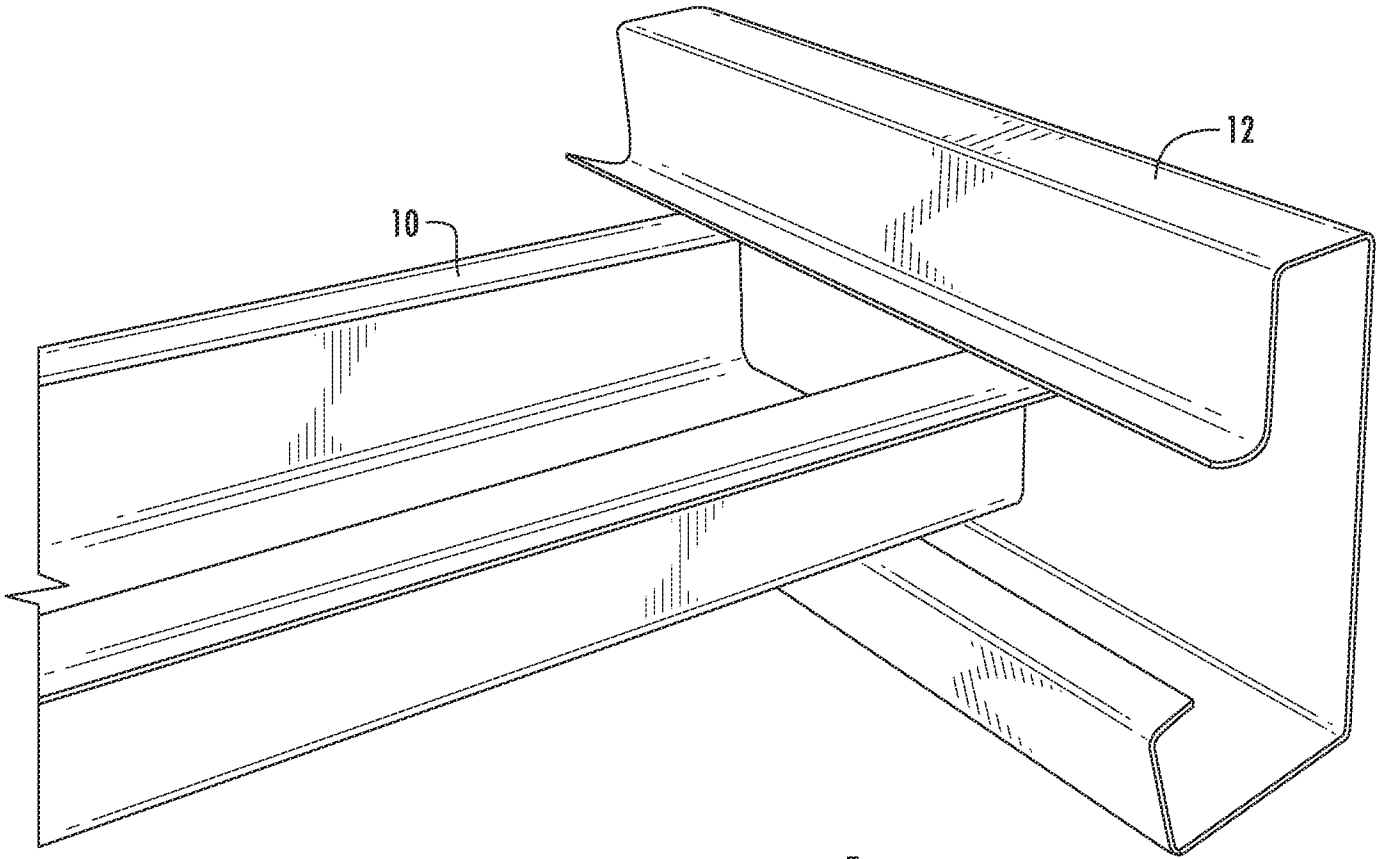
FIG. 1 is a perspective view of a portion of a channel and gutter oriented in accordance with one embodiment of this invention.
Figure 2:
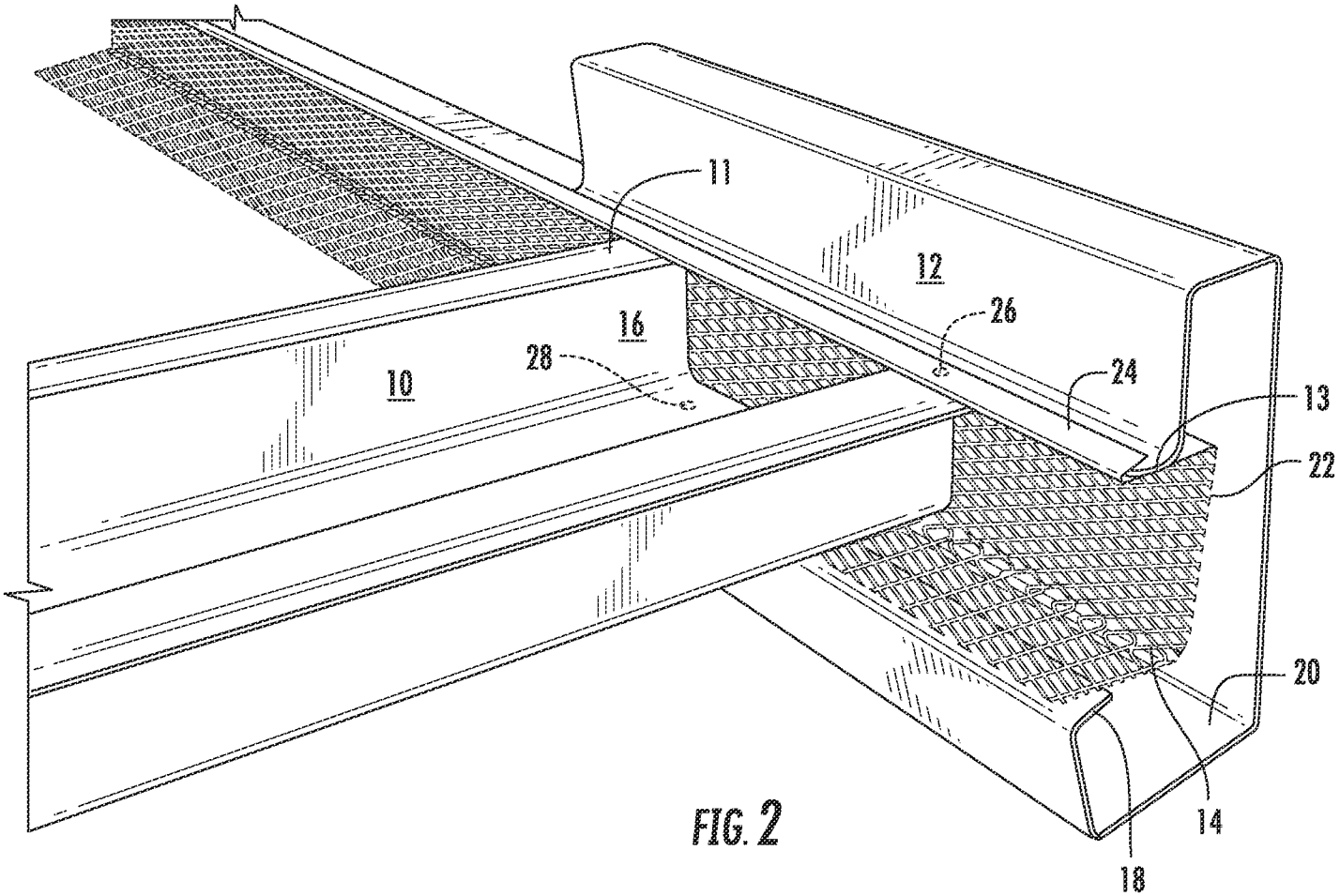
FIG. 2 is a perspective view similar to FIG. 1 together with an exemplary screen component of one embodiment of this invention.

FIG. 1 is a perspective view of an exemplary channel 10 and gutter 12 of this invention configured relative to each other as they will be when assembled with a screen 14, as depicted in FIG. 2. As may be easily understood by reference to FIGS. 1-2, the end 16 of channel 10 extends beyond and rests on the lower, in-turned lip 18 of gutter 12 so that water in a channel 10 sloping toward gutter 12 will drain into gutter 12 and be conveyed along bottom 20 of gutter 12. The geometry of this channel and gutter arrangement makes it difficult to clear debris from gutter 12 because the gutter is largely closed. Such a channel and gutter assembly can be fastened together with screws, rivets or other appropriate fasteners passing, for instance, at point 26 through lip 13 of gutter 12 and into flange 11 of channel 10. Like fasteners can also pass through the bottom of channel 10 at point 28 into gutter 12 through lip 18. The components could also be fastened with adhesive, welding and other materials and techniques.

Figure 3:
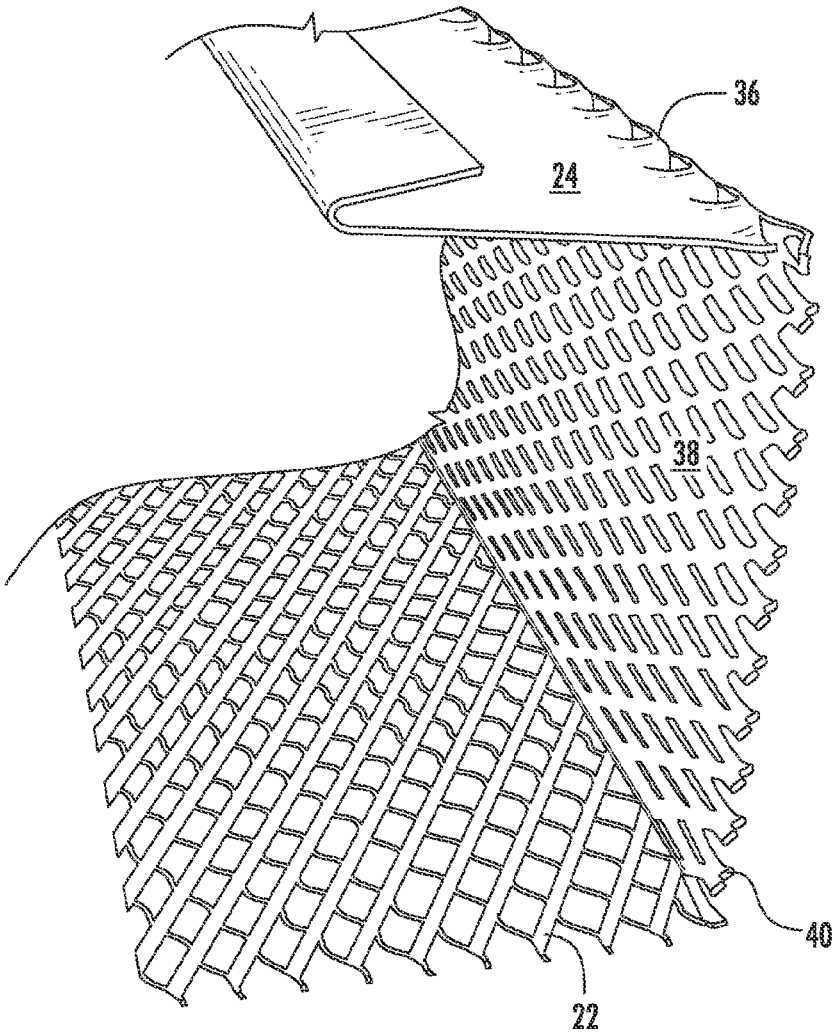
FIG. 3 is a perspective view of the screen depicted in FIG. 2.

Screen 14 depicted separately in FIG. 3 and with channel 10 and gutter 12 components in FIG. 2 provides a debris barrier at each of the ends 16 of side-by-side channels 10 that will stop passage of debris larger than the screen 14 openings into gutter 12. These openings can be any suitable shape (e.g., but not limited to, diamond, hexagon, circular, square). Debris small enough to pass through the openings in screen 14 into gutter 12 typically will wash through gutter 12 when there is any significant flow of water.

As may be seen in FIGS. 2 and 3, screen 14 can be fabricated from a sheet of aluminum so that it includes an "expanded metal" portion 22 attached to a solid (unexpanded) portion 24. Screen 14 can be fabricated from any suitable material including but not limited to steel, copper, vinyl, or any suitable plastic. Such a combined screen and solid metal structure can be manufactured as described in U.S. Pat. No. 6,629,016 for "Apparatus and Method of Manufacturing Expanded Sheet Metal," issued Sep. 30, 2003, which patent is incorporated herein in its entirety by reference. Fabrication of screen 14 with a solid metal strip is particularly desirable because the solid metal portion 24 bent around lip 13 of gutter 12 is visually attractive and does not orient exposed portions of screen 14 horizontally, which might trap debris. Moreover, solid metal portion 24 allows the screen 14 to easily and securely fit in between the gutter 12 and the channels 10, which allows for an easy and clean installation. In particular, the solid metal portion 24 may be mated uniformly across the length of the gutter 12.

As may be easily seen in FIG. 3, which depicts the screen 14 separate from other components, solid metal portion 24 can bend around flange 13 of gutter 12 (as shown in FIG. 2) and project horizontally into gutter 12 until it reaches a more or less right angle bend 36 at approximately the interface between solid portion 24 and expanded metal portion 22, which expanded metal portion 22 has a vertical portion 38 that drops to another approximately right angle bend 40 from which the expanded metal portion 22 becomes horizontal so that it may extend under the ends 16 of channels 10 and on top of lip 18 of gutter 12.

Fasteners such as sheet metal screws, rivets or bolts can pass through portions of screen 14 lying against lip 18 or flange 13 when the roof or other structure is assembled to fix screen 14 firmly in place. Screen 14 can likewise be secured with adhesive, welding or other appropriate fasteners or securing means. Screen 14 could also be permanently or temporally attached to gutter 12 in a factory or at some other point in advance of assembly of the channel 10 and gutter 12 components. Such preliminary assembly of the screen and gutter could be accomplished using a different fastening means, such as adhesive, from the fasteners, such as screws or other metal fasteners, used to assemble the channel and gutter and other components.

Numerous alternative screen 14 structures and materials are possible. For instance screen 14 could be fabricated entirely with expanded metal. Sheet metal and other sheet materials such as plastics could also be used that are punched, drilled, molded, slit, stretched, expanded or otherwise perforated to permit the flow of water there through. Woven materials could be used made of metal wire or fiberglass, carbon, polymer, plastic or other fibers or strands. Other materials and structures could also be used provided that they limit the passage of debris from the channels 10 into gutters 12.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

As an example of additional embodiments of this invention, gutter 12 and screen 14 could be formed together from the same strip of sheet aluminum or other material by expanding, punching, drilling, perforating, stretching or otherwise forming openings into a one longitudinal edge of the sheet and then bending the cutter and screen edge into a channel having approximately the cross-sectional shape of both the screen 14 and the gutter 12 as in the Figures.

That which is claimed is:

1. A roof assembly comprising:

a. a plurality of elongated channels having two ends, b. a gutter comprising a generally horizontal lip or flange on each of two longitudinal edges and a longitudinal opening into which one of each of the two ends of the plurality of channels extends, and c. a screen formed from aluminum sheet and comprising a solid portion and a perforated portion, wherein the solid portion includes one solid longitudinal edge that is wrapped around one of the generally horizontal lip or flange and wherein the screen is positioned at at least a plurality of the ends extending into the gutter and is operatively attached to each horizontal lip or flange.

2. The roof assembly of claim 1, wherein the perforated portion is formed by slitting and stretching.

3. A screen for use with a roof assembly comprising a plurality of elongated channels having two ends, and at least one gutter comprising a generally horizontal lip or flange on each of two longitudinal edges and a longitudinal opening into which one of each of the two ends of the plurality of channels extends, wherein the screen is formed from aluminum sheet and comprises a solid portion and a perforated portion, wherein the solid portion includes one solid longitudinal edge that is wrapped around one of the generally horizontal lip or flange and wherein the screen comprises relatively small openings for permitting water to pass there through while preventing leaves and other similar debris from entering the gutter, wherein the screen is positioned across at least a plurality of the channel ends extending into the gutter and is operatively attached to each horizontal lip or flange.

4. The screen of claim 3, wherein the perforated portion has been slit and expanded to produce openings there through significantly smaller in cross-sectional area than a cross sectional area of each of the channel ends.

5. A kit of parts for assembly of a roof comprising:

a. a plurality of elongated channels, each having a first end and a second end, b. at least one gutter comprising a generally horizontal lip or flange on each of two longitudinal edges and a longitudinal opening into which each of first ends of the plurality of channels may extend, and c. a plurality of screens formed from aluminum sheet and of total length at least as great as a length of the at least one gutter, each of the plurality of screens positionable across the first ends of the channels when assembled with the gutter and suitable fasteners and support structure and each of the plurality of screens comprising a solid portion and a perforated portion, wherein the solid portion includes one solid longitudinal edge that is wrappable around one of the generally horizontal lip or flange when assembled with the gutter and wherein each of the plurality of screens is operatively attachable to each horizontal lip or flange.

* * * * *